US011498787B2

(12) United States Patent
Chen

(10) Patent No.: US 11,498,787 B2
(45) Date of Patent: Nov. 15, 2022

(54) CARD-FEEDING DEVICE AND BADGE AND CARD PRINTER HAVING SAME

(71) Applicant: Shen Zhen Seaory Technology Co., Ltd., Guangdong (CN)

(72) Inventor: Yaohui Chen, Guangdong (CN)

(73) Assignee: SHEN ZHEN SEAORY TECHNOLOGY CO., LTD., Guangdong (CN)

( * ) Notice: Subject to any disclaimer, the term of this patent is extended or adjusted under 35 U.S.C. 154(b) by 351 days.

(21) Appl. No.: 16/837,228

(22) Filed: Apr. 1, 2020

(65) Prior Publication Data

US 2021/0221634 A1 Jul. 22, 2021

(30) Foreign Application Priority Data

Jan. 17, 2020 (CN) ..... 202010055720.3

(51) Int. Cl.
*B65H 3/24* (2006.01)
*B65H 1/06* (2006.01)
*B65H 3/06* (2006.01)

(52) U.S. Cl.
CPC ..... *B65H 3/24* (2013.01); *B65H 1/06* (2013.01); *B65H 3/063* (2013.01); *B65H 3/0638* (2013.01); *B65H 2405/11161* (2013.01); *B65H 2701/1914* (2013.01)

(58) Field of Classification Search
CPC ..... B65H 1/06; B65H 3/063; B65H 3/0638; B65H 3/0669; B65H 3/24; B65H 3/60; B65H 3/62; B65H 2405/1116; B65H 2405/11161; B65H 2404/731; B65H 2701/1914; B65H 5/16
See application file for complete search history.

(56) References Cited

U.S. PATENT DOCUMENTS 4,181,298 A * 1/1980 Capdeboscq ..... B65H 3/24 271/99
5,219,157 A * 6/1993 Takahashi ..... B65H 3/122 271/118
5,667,355 A * 9/1997 Gamperling ..... B65H 3/24 414/795.8
2009/0134571 A1* 5/2009 Kotaka ..... B65H 5/062 271/264

FOREIGN PATENT DOCUMENTS

CN 105243402 * 1/2016 ..... G06K 13/14
CN 108275484 * 7/2018 ..... B65H 5/16
JP 2932038 B2 * 5/1999 ..... B65H 3/06
JP 2932038 B2 * 8/1999

* cited by examiner

*Primary Examiner* — Prasad V Gokhale
(74) *Attorney, Agent, or Firm* — Locke Lord LLP; Tim Tingkang Xia, Esq.

(57) ABSTRACT

The present invention discloses a card-feeding device and a badge and card printer. The card-feeding device comprises: a base on which cards are stacked, a card outlet being provided at one end of the base; a rotary card-feeding mechanism which is located below the bottommost card and provided with a rotary swing arm and a push rod provided on the rotary swing arm, the push rod pushing the bottommost card towards the card outlet as the swing arm rotates; and a roller card-feeding mechanism which is installed between the rotary card-feeding mechanism and the card outlet and provided with a roller with an outer edge protruding from the top surface of the base, the bottommost card being transported to the card outlet when the roller rotates.

20 Claims, 5 Drawing Sheets

CARD-FEEDING DEVICE AND BADGE AND CARD PRINTER HAVING SAME

CROSS-REFERENCE TO RELATED PATENT APPLICATION

This non-provisional application claims priority to and the benefit of, pursuant to 35 U.S.C. § 119(a), Chinese Patent Application No. CN202010055720.3 filed in China on Jan. 17, 2020. The disclosure of the above application is incorporated herein in its entirety by reference.

FIELD

The present invention relates to the technical field of printers, and more particularly to a card-feeding device and a badge and card printer having the same.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A badge and card printer is equipment for printing badges. In daily work and life, various photo-printed chest cards or badges that we see are printed through this equipment. When the badge and card printer prints, it is necessary to separate stacked cards and feed them individually. What plays a key role in this process is its internal card-feeding device.

A card-feeding device of the existing badge and card printer usually transports a card to cards outlet by using a friction force of rollers. Because the cards are stacked on a base of the card-feeding device, the electrostatic adsorption force between the cards is large, and the friction force of the rollers is likely to be insufficient to separate the underlying cards, resulting in failure of card-feeding. The badge and card printer often experiences downtime, which seriously affects the work efficiency.

Therefore, how to design a card-feeding device with a high card-feeding success rate is a technical problem that the industry urgently needs to solve.

SUMMARY

In order to overcome the defects that the existing card-feeding device is prone to card-feeding failure, the present invention provides a card-feeding device and a badge and card printer having the card-feeding device. The card-feeding device uses a rotary card-feeding mechanism and a roller card-feeding mechanism to drive card-feeding, which can take into account the success rate and the card-feeding speed.

The technical solution adopted in the present invention is to design a card-feeding device, comprising: a base on which cards are stacked, a card outlet being provided at one end of the base; a rotary card-feeding mechanism which is located below the bottommost card and provided with a rotary swing arm and a push rod provided on the rotary swing arm, the push rod pushing the bottommost card towards the card outlet as the swing arm rotates; and a roller card-feeding mechanism which is installed between the rotary card-feeding mechanism and the card outlet and provided with a roller with an outer edge protruding from the top surface of the base, the bottommost card being transported to the card outlet when the roller rotates.

Preferably, the base is provided with a rotary groove for accommodating the rotation of the rotary swing arm, wherein the depth of the rotary groove changes continuously and matches a rotation trajectory of the rotary swing arm, the depth at a first extreme position on the rotary groove farthest from the card outlet is the smallest, and the depth at a second extreme position on the rotary groove closest to the card outlet is the largest;

when the push rod is rotated to the first extreme position, the push rod is raised to expose the top surface of the base; and when the push rod is rotated to the second extreme position, the push rod sinks to be located below the top surface of the base.

Preferably, the rotary card-feeding mechanism also has a rotary table, wherein the middle of the swing arm is hinged on the rotary table, one end, which is provided with a push rod, of the rotary swing arm is a hook end, and the other end of the rotary swing arm is an adjusting end;

when the hook end rotates toward the first extreme position, the rotary groove gradually lifts the hook end upward; and when the adjusting end rotates toward the first extreme position, the rotary groove gradually lifts the adjusting end upward, such that the hook end sinks.

Preferably, the rotary card-feeding mechanism is also provided with a worm gear fixed on the bottom of the rotary table and a worm rod meshed with the worm gear, one end of the worm rod penetrates out of the base and serves as a transmission end, and the transmission end is driven to rotate by a power mechanism.

Preferably, the transmission end is fixedly sleeved with a one-way bearing having an outer ring being connected with the power mechanism, wherein when the power mechanism rotates, the transmission end is driven to rotate by a reverse resistance of the one-way bearing.

Preferably, the roller is fixed on a rotary shaft arranged coaxially therewith, wherein one end of the rotary shaft penetrates out of the base and serves as a rotary end, and the rotary end is driven to rotate by the power mechanism.

Preferably, the rotary end is fixedly sleeved with a one-way bearing having an outer ring being connected with the power mechanism, wherein when the power mechanism rotates, the rotary end is driven to rotate by a reverse resistance of the one-way bearing.

Preferably, an outer ring of the one-way bearing is fixedly sleeved with a driven gear, the power mechanism is provided with a motor, and an output shaft of the motor is fixedly sleeved with a driving gear meshed with the driven gear.

Preferably, an outer edge of the roller is covered with an adhesive layer for increasing a friction force.

The present invention further provides a badge and card printer, which comprises the above card-feeding device.

Compared with the prior art, the present invention integrates two card-feeding methods for card feeding. The rotary card-feeding mechanism is used to separate the bottom cards and push them to the card outlet, thereby increasing a card-feeding success rate. The roller card-feeding mechanism is used to further transport the cards to the card outlet, thereby increasing the card-feeding speed.

BRIEF DESCRIPTION OF THE DRAWINGS

The present invention is described in detail below with reference to the embodiments and the drawings, in which.

DETAILED DESCRIPTION

To make the objectives, technical solutions, and advantages of the present invention clearer, the present invention is further described in detail hereinafter with reference to the accompanying drawings and embodiments. It should be understood that the specific embodiments described here are only used to explain the present invention, and are not used to limit the present invention.

Figure 1:
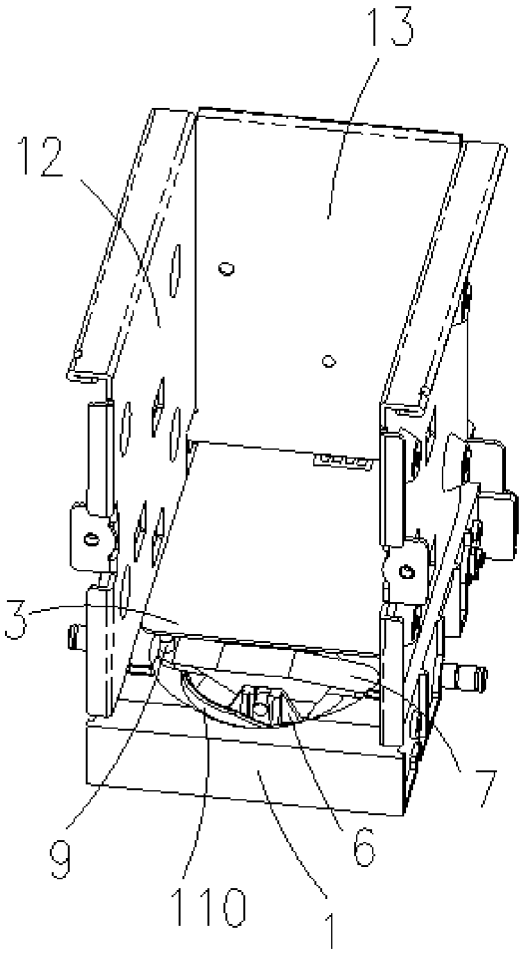
FIG. 1 is a schematic diagram of a rotary swing arm rotating to a middle position of a rotary groove in the present invention.
Figure 2:
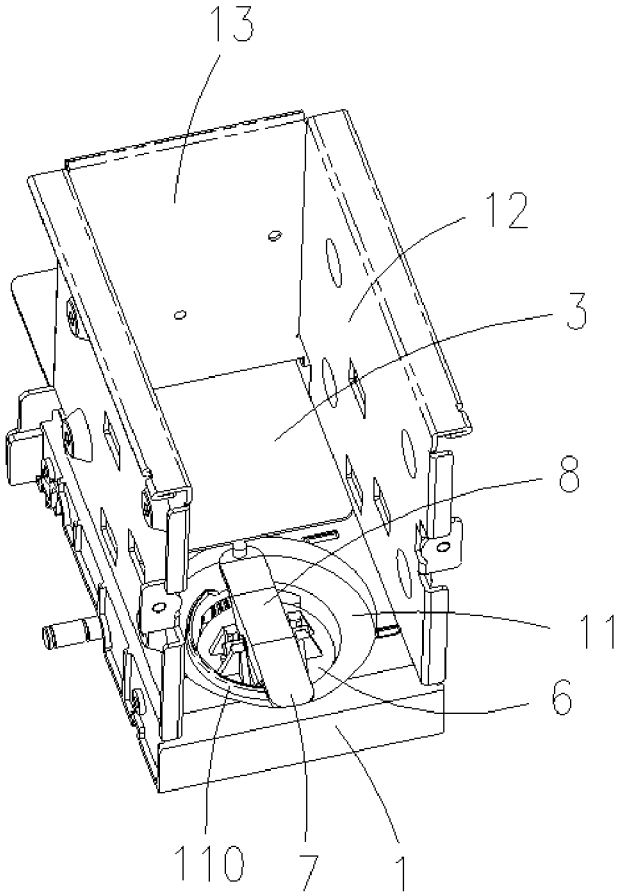
FIG. 2 is a schematic diagram of the rotary swing arm rotating to a second extreme position in the present invention.
Figure 3:
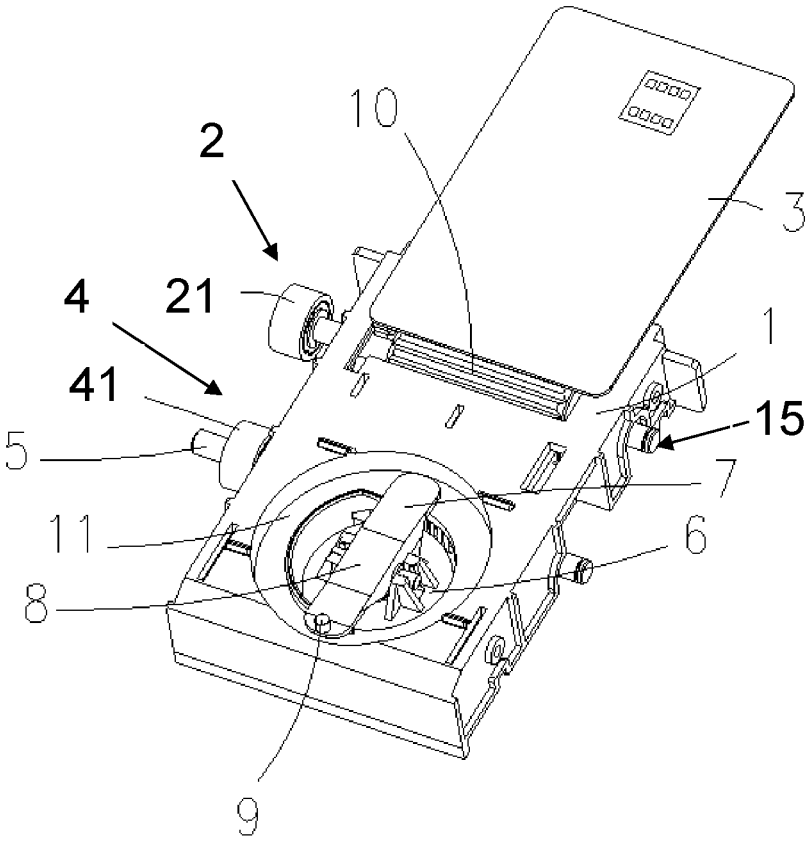
FIG. 3 is a schematic structural diagram of a card-feeding device in the present invention.

As shown in FIGS. 1 to 3, a card-feeding device provided by the present invention is suitable for use in equipment such as a printer, and is particularly suitable for use in a badge and card printer. The card-feeding device comprises a base 1, a rotary card-feeding mechanism and a roller card-feeding mechanism. A side plate 12 is installed on each of two sides of the base 1. A baffle plate 13 connected between two side plates 12 is provided at one end of the base 1. A storage chamber is formed between the side plates 12 and the baffle plate 13. Cards 3 are stacked in the storage chamber. The baffle plate 13 is spaced from the top surface of the base 1 to form a card outlet. Assuming that the thickness of a single card 3 is L, the distance is larger than L and less than 2 L, thereby preventing two cards 3 from being pushed out at the same time. In order to better locate the card 3, the size of the storage chamber may be designed to be in clearance fit with the card 3 in practice.

The rotary card-feeding mechanism is located below the bottommost card 3. The rotary card-feeding mechanism comprises a rotary table 6, a rotary swing arm 8 and a push rod 9. The base 1 is provided with a cavity in which the rotary table 6 is installed. The middle of the rotary swing arm 8 is hinged on the rotary table 6. The push rod 9 is provided on one end of the rotary swing arm 8, and this end serves as a hook end of the rotary swing arm 8. The other end of the rotary swing arm 8 is an adjusting end 7. A pair of lugs is provided in the middle of the swing arm 8. A supporting portion located between the pair of lugs is arranged on the rotary table 6. A hinge shaft passes through the pair of lugs and the supporting portion. The rotary swing arm 8 is in a state of a seesaw after being completely installed.

The base 1 is also provided with a rotary groove 11 for accommodating the rotation of the rotary swing arm 8. The rotary groove 11 is circular in a plan view. The depth of the rotary groove 11 continuously changes, and the depth matches a rotation trajectory of the rotary swing arm 8. In more detail, the rotary groove 11 is provided with an arc-shaped rib 110 located below the rotary swing arm 8. The height of the arc-shaped rib 110 continuously changes so that the depth of the rotary groove 11 continuously changes. The higher the height of the arc-shaped rib 110, the smaller the depth of the rotary groove 11 relative to the rotary swing arm 8; the lower the height of the arc-shaped rib 110, the greater the depth of the rotary groove 11 relative to the rotary swing arm 8. The depth of the first extreme position on the rotary groove 11 farthest from the card outlet is the smallest, that is, the height of the corresponding position on the arc-shaped rib 110 is the largest; and the depth of the second extreme position on the rotary groove 11 closest to the card outlet is the largest, that is, the height of the corresponding position on the arc-shaped rib 110 is the smallest.

Figure 4:
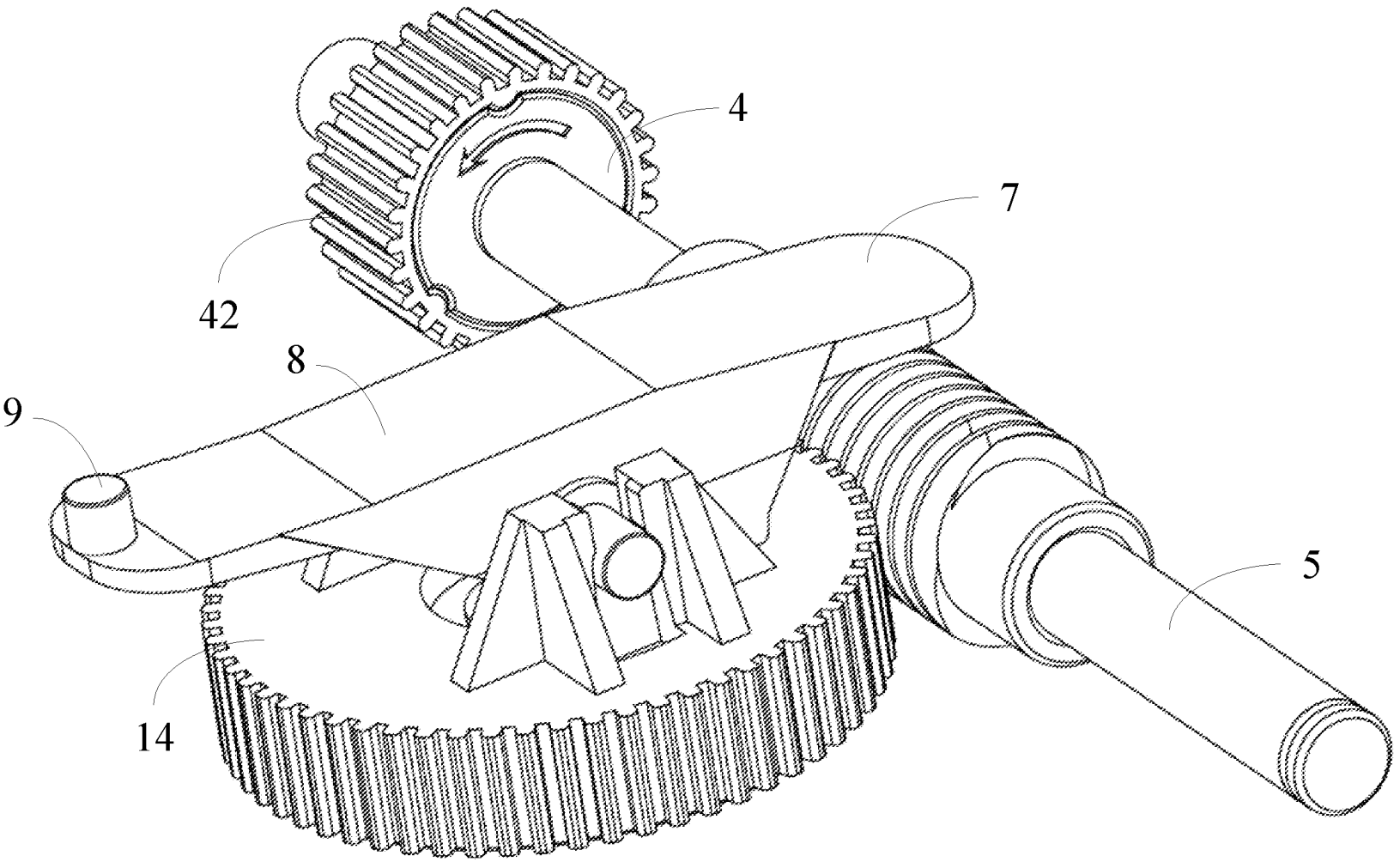
FIG. 4 is a schematic structural diagram showing components of the rotary card-feeding mechanism of the card-feeding device without the rotary table as shown in FIG. 3.

FIG. 4 is a schematic structural diagram showing components of the rotary card-feeding mechanism. Specifically, FIG. 4 is provided to show the rotary card-feeding mechanism without the rotary table 6 in order to show the components below the rotary table 6. As shown in FIG. 4, the rotary card-feeding mechanism further comprises a worm gear 14 fixed on the bottom of the rotary table 6 and a worm rod 5 meshed with the worm gear, one end of the worm rod 5 penetrates out of the base and serves as a transmission end, and the transmission end is driven to rotate by a power mechanism. The worm rod 5 rotates to drive the worm gear 14 to rotate. In order to make the transmission more precise, the worm gear 14 and the rotary table 6 are arranged coaxially. The middle of the rotary swing arm 8, that is, a hinge position, is located exactly on the axis of the rotary table 6.

As shown in FIGS. 1 and 2, when the rotary table 6 rotates, the push rod 9 rotates together with the rotary swing arm 8. The hook end gradually rotates to the first extreme position. The depth of the rotary groove 11 is gradually reduced (correspondingly, the height of the arc-shaped rib 110 is gradually increased) to raise the hook end upward. The push rod 9 is gradually exposed from the top surface of the base 1. When the push rod 9 moves to the first extreme position, the height of the push rod exceeding the top surface of the base 1 is the largest. The exceeded height cannot exceed the thickness L of a single card 3, thereby preventing two bottommost cards 3 from being pushed out simultaneously when the push rod 9 continues to move. When the push rod 9 rotates to the first extreme position, the card 3 is located between the push rod 9 and the card outlet. The rotary table 6 is continued to be rotated, and the push rod 9 rotates with the rotary swing arm 8. The hook end gradually rotates to the second extreme position, and the adjusting end gradually rotates to the first extreme position. The arc-shaped rib 110 gradually lifts the adjusting end 7 upward, and the adjusting end 7 is raised to force the hook end to sink. During the rotation of the hook end, the push rod 9 pushes the edge of the bottommost card 3 to move it away from the cards 3 stacked above to the card outlet. When the hook end moves to the second extreme position, neither the adjusting end 7 nor the push rod 9 exceeds the top surface of the base 1, thereby preventing the surface layer of the card 3 from being damaged during the movement. In a preferred embodiment, the hook end is heavier than the adjusting end 7. When the hook end rotates to the second extreme position, the depth of the rotary groove 11 gradually increases (correspondingly, the height of the arc-shaped rib 110 gradually decreases). The hook end automatically sinks under the joint action of upwrapping and the own gravity of the adjusting end 7, and the height fluctuation movement of two ends of the rotary swing arm 8 is more flexible and smooth.

As shown in FIG. 3, the roller card-feed mechanism is installed between the rotary card-feeding mechanism and the card outlet. The roller card-feeding mechanism comprises a roller 10 having an outer edge protruding from the top surface of the base 1. When the roller 10 rotates, the bottommost card 3 pushed out by the rotary card-feeding mechanism is continuously transported to the card outlet by using a friction force, thereby improving the card-feeding efficiency. Further optimally, the outer edge of the roller 10 is covered with an adhesive layer. The adhesive layer can not only increase the friction force, but also protect the surface layer of the card 3, thereby preventing the roller 3 from scratching the card 3.

The roller card-feeding mechanism comprises a rotating shaft 15 fixed coaxially with the roller 10. One end of the rotating shaft 15 penetrates out of the base 1 and serves as a rotating end. The rotary end is driven by a power mechanism to rotate. When the rotating shaft 15 rotates to drive the roller 10 to rotate, the roller 10 is in contact with the bottom surface of the card 3 above the roller, such that the card 3 is transported to the card outlet.

Figure 5:
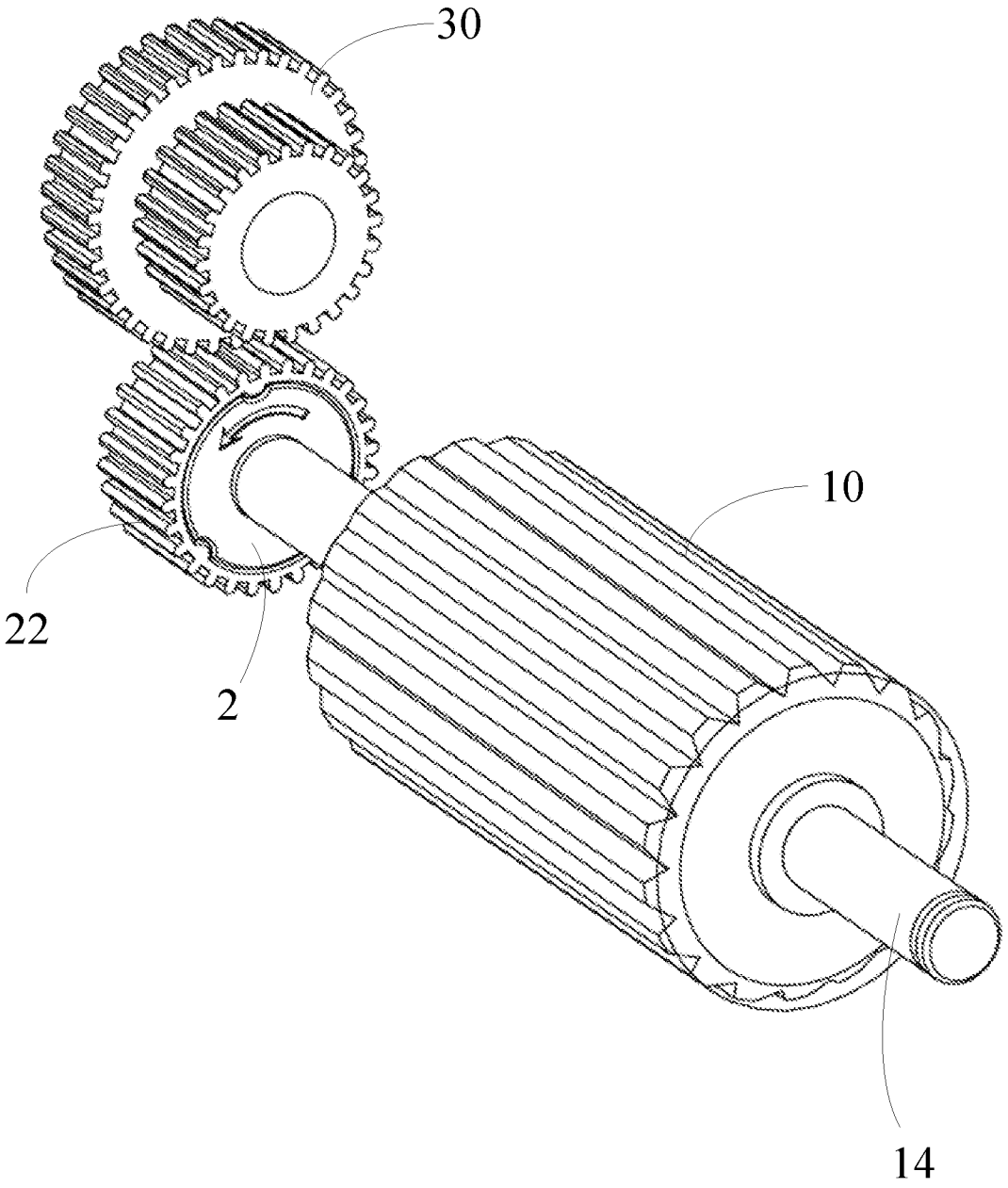
FIG. 5 is a schematic structural diagram showing components of the roller card-feeding mechanism of the card-feeding device as shown in FIG. 3.

In order to make the structure compact, the rotary card-feeding mechanism and the roller card-feeding mechanism share a power mechanism. The specific structure is as follows: a first one-way bearing 4 is provided between the transmission end and the power mechanism, and an inner ring of the first one-way bearing 4 sleeves fixedly transmission end. A second one-way bearing 2 is provided between the rotary end and the power mechanism, and an inner ring of the second one-way bearing 2 fixedly sleeves the rotary end. The outer ring of each of the two one-way bearings is fixedly sleeved with a driven gear. Specifically, as shown in FIG. 3, the first one-way bearing 4 has an outer ring 41, and the second one-way bearing 2 has an outer ring 21. As shown in FIG. 4, a first driven gear 42 is sleeved on the outer ring 41 of the first one-way bearing 4. As shown in FIG. 5, a second driven gear 22 is sleeved on the outer ring 21 of the second one-way bearing 2. The power mechanism comprises a motor (not shown) and a driving gear (not shown) fixedly sleeving an output shaft of the motor. Both of the driven gears 22 and 42 are meshed with the driving gear. Specifically, each of the driven gears 22 and 42 may be meshed with driving gear directly or indirectly. For example, as shown in FIG. 5, the second driven gear 22 is meshed directly with a gear 30 (which functions as an intermediate gear) of the power mechanism, and the power mechanism may include other gears (not shown) between the gear 30 and the driving gear, such that the driving gear of the power mechanism may drive the second driven gear 22 through the intermediate gear 30 and the other gears. During the transmission of the power mechanism, the corresponding transmission end and the rotating end driven by a reverse resistance of the one-way bearings to rotate.

Of course, in actual applications, two motors may also be used to drive the rotary card-feeding mechanism and the roller card-feeding mechanism to operate respectively, which is not limited in the present invention.

The foregoing descriptions are merely exemplary embodiments of the present disclosure, and are not intended to limit the present disclosure. Within the spirit and principles of the disclosure, any modifications, equivalent substitutions, improvements, etc., are within the protection scope of the present disclosure.

What is claimed is:

1. A card-feeding device, comprising:

a base on which cards are stacked, a card outlet being provided at one end of the base;

a rotary card-feeding mechanism which is located below the bottommost card and provided with a rotary swing arm and a push rod provided on the rotary swing arm, the push rod pushing the bottommost card towards the card outlet as the swing arm rotates; and a roller card-feeding mechanism which is installed between the rotary card-feeding mechanism and the card outlet and provided with a roller with an outer edge protruding from the top surface of the base, the bottommost card being transported to the card outlet when the roller rotates, wherein the roller is fixed on a rotary shaft arranged coaxially therewith, one end of the rotary shaft penetrates out of the base and serves as a rotary end, and the rotary end is driven to rotate by a power mechanism.

2. The card-feeding device according to claim 1, wherein the base is provided with a rotary groove for accommodating the rotation of the rotary swing arm, wherein the depth of the rotary groove changes continuously and matches a rotation trajectory of the rotary swing arm, the depth at a first extreme position on the rotary groove farthest from the card outlet is the smallest, and the depth at a second extreme position on the rotary groove closest to the card outlet is the largest;

when the push rod is rotated to the first extreme position, the push rod is raised to expose the top surface of the base; and when the push rod is rotated to the second extreme position, the push rod sinks to be located below the top surface of the base.

3. The card-feeding device according to claim 2, wherein the rotary card-feeding mechanism also has a rotary table, wherein the middle of the swing arm is hinged on the rotary table, one end, which is provided with the push rod, of the rotary swing arm is a hook end, and the other end of the rotary swing arm is an adjusting end;

when the hook end rotates toward the first extreme position, the rotary groove gradually lifts the hook end upward;

when the adjusting end rotates toward the first extreme position, the rotary groove gradually lifts the adjusting end upward, such that the hook end sinks.

4. The card-feeding device according to claim 3, wherein the rotary card-feeding mechanism is also provided with a worm gear fixed on the bottom of the rotary table and a worm rod meshed with the worm gear, one end of the worm rod penetrates out of the base and serves as a transmission end, and the transmission end is driven to rotate by the power mechanism.

5. The card-feeding device according to claim 4, wherein the transmission end is fixedly sleeved with a one-way bearing having an outer ring being connected with the power mechanism, wherein when the power mechanism rotates, the transmission end is driven to rotate by a reverse resistance of the one-way bearing.

6. The card-feeding device according to claim 5, wherein the outer ring of the one-way bearing is fixedly sleeved with a driven gear, the power mechanism is provided with a motor, and an output shaft of the motor is fixedly sleeved with a driving gear meshed with the driven gear.

7. A badge and card printer, comprising the card-feeding device according to claim 6.

8. A badge and card printer, comprising the card-feeding device according to claim 5.

9. A badge and card printer, comprising the card-feeding device according to claim 4.

10. A badge and card printer, comprising the card-feeding device according to claim 3.

11. A badge and card printer, comprising the card-feeding device according to claim 2.

12. The card-feeding device according to claim 1, wherein the outer edge of the roller is covered with an adhesive layer for increasing a friction force.

13. A badge and card printer, comprising the card-feeding device according to claim 1.

14. The card-feeding device according to claim 1, wherein the outer edge of the roller is covered with an adhesive layer for increasing a friction force.

15. A card-feeding device, comprising:

a base on which cards are stacked, a card outlet being provided at one end of the base;

a rotary card-feeding mechanism which is located below the bottommost card and provided with a rotary swing arm and a push rod provided on the rotary swing arm, the push rod pushing the bottommost card towards the card outlet as the swing arm rotates; and a roller card-feeding mechanism which is installed between the rotary card-feeding mechanism and the card outlet and provided with a roller with an outer edge protruding from the top surface of the base, the bottommost card being transported to the card outlet when the roller rotates, wherein the rotary card-feeding mechanism is also provided with a rotary table, a worm gear fixed on the bottom of the rotary table and a worm rod meshed with the worm gear, one end of the worm rod penetrates out of the base and serves as a transmission end, and the transmission end is driven to rotate by a power mechanism.

16. The card-feeding device according to claim 15, wherein the base is provided with a rotary groove for accommodating the rotation of the rotary swing arm, wherein the depth of the rotary groove changes continuously and matches a rotation trajectory of the rotary swing arm, the depth at a first extreme position on the rotary groove farthest from the card outlet is the smallest, and the depth at a second extreme position on the rotary groove closest to the card outlet is the largest;

when the push rod is rotated to the first extreme position, the push rod is raised to expose the top surface of the base; and when the push rod is rotated to the second extreme position, the push rod sinks to be located below the top surface of the base.

17. The card-feeding device according to claim 16, wherein the middle of the swing arm is hinged on the rotary table, one end, which is provided with the push rod, of the rotary swing arm is a hook end, and the other end of the rotary swing arm is an adjusting end;

when the hook end rotates toward the first extreme position, the rotary groove gradually lifts the hook end upward;

when the adjusting end rotates toward the first extreme position, the rotary groove gradually lifts the adjusting end upward, such that the hook end sinks.

18. The card-feeding device according to claim 15, wherein the transmission end is fixedly sleeved with a one-way bearing having an outer ring being connected with the power mechanism, wherein when the power mechanism rotates, the transmission end is driven to rotate by a reverse resistance of the one-way bearing.

19. The card-feeding device according to claim 18, wherein the outer ring of the one-way bearing is fixedly sleeved with a driven gear, the power mechanism is provided with a motor, and an output shaft of the motor is fixedly sleeved with a driving gear meshed with the driven gear.

20. The card-feeding device according to claim 15, wherein the roller is fixed on a rotary shaft arranged coaxially therewith, wherein one end of the rotary shaft penetrates out of the base and serves as a rotary end, and the rotary end is driven to rotate by the power mechanism.

* * * * *